United States Patent [19]

Hoosier

[11] 4,273,172

[45] Jun. 16, 1981

[54] NAIL HOLDING HAMMER HEAD

[76] Inventor: Jack D. Hoosier, 488 Hill Rd., Green Lane, Pa. 18054

[21] Appl. No.: 149,185

[22] Filed: May 12, 1980

[51] Int. Cl.[3] ..... B25C 1/00; B25D 1/00

[52] U.S. Cl. ..... 145/30 R; 145/30 A

[58] Field of Search ..... 145/30 R, 30 A

[56] References Cited

U.S. PATENT DOCUMENTS

| | | | |
|---|---|---|---|
| 418,539 | 12/1889 | Stark | 145/30 A |
| 509,399 | 11/1893 | Richardson | 145/30 R |
| 1,718,733 | 6/1929 | Dominick | 145/30 R |
| 2,597,876 | 5/1952 | Kurkjian | 145/30 A |

FOREIGN PATENT DOCUMENTS

| | | | |
|---|---|---|---|
| 1335243 | 7/1963 | France | 145/30 A |

*Primary Examiner*—Othell M. Simpson
*Assistant Examiner*—J. T. Zatarga
*Attorney, Agent, or Firm*—Raymond Underwood

[57] ABSTRACT

A hammer head has a longitudinal groove leading from the striking face to temporarily hold a nail and has a plurality of transverse grooves to receive the nail heads and provide nail head abutment surfaces, the bottom of the longitudinal groove being stepped upwardly between the transverse grooves away from the striking surface so that finishing nails will be accommodated.

4 Claims, 6 Drawing Figures

Fig. 1
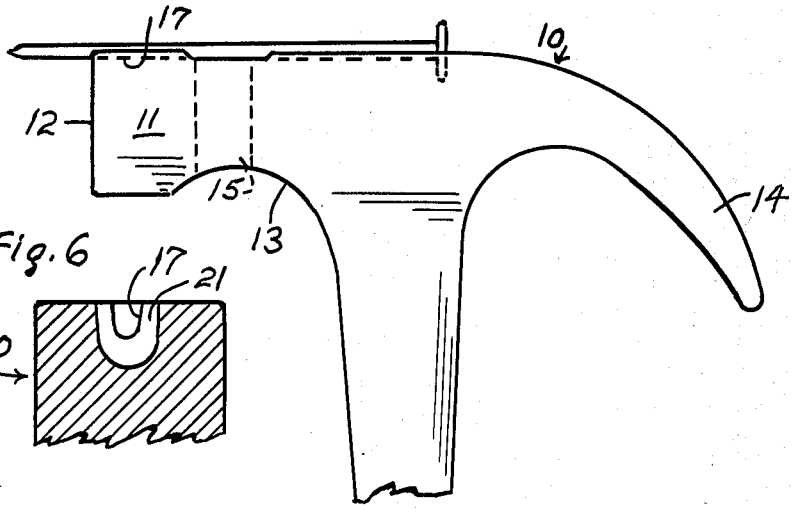
Fig. 5
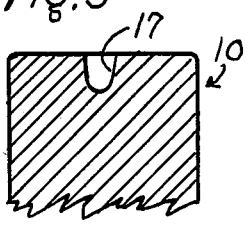
Fig. 6
Fig. 2
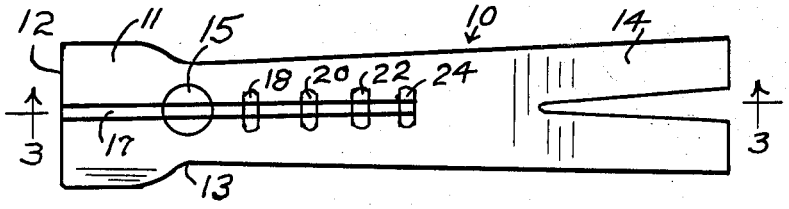
Fig. 3
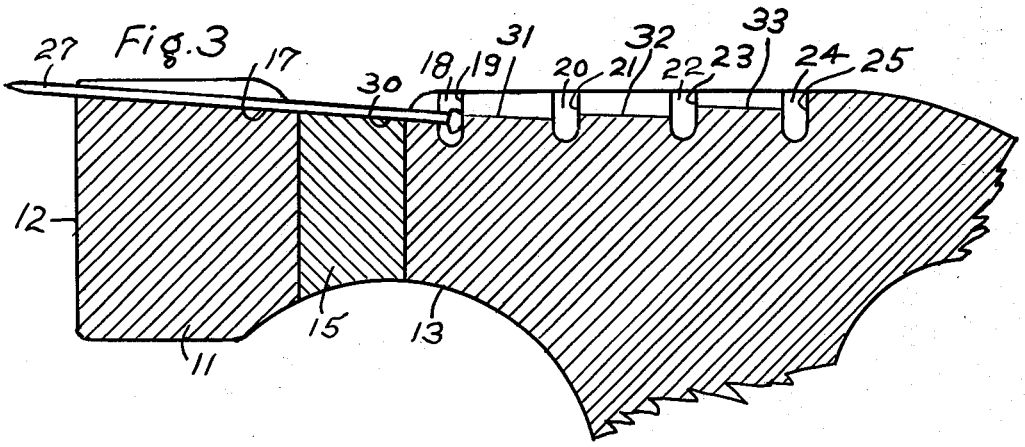
Fig. 4
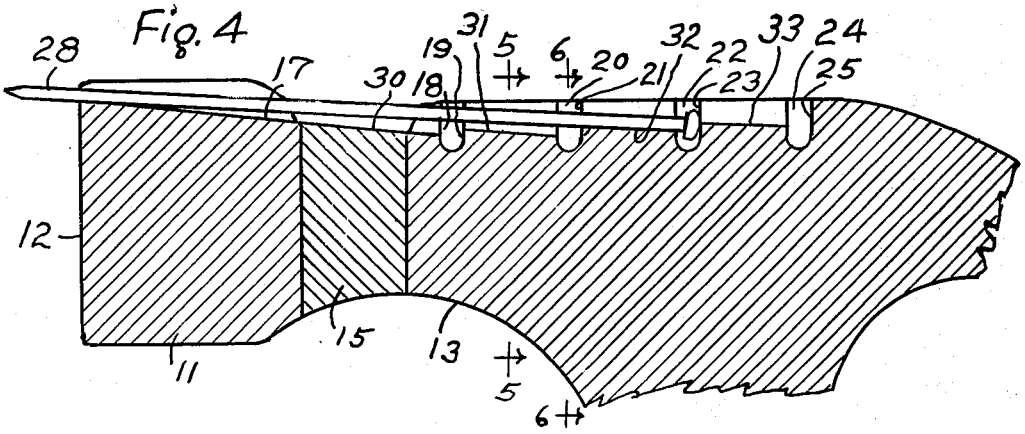

NAIL HOLDING HAMMER HEAD

This invention relates to hammers and particularly to a hammer head which is so constructed that it will temporarily hold a nail which is to be struck into a receiving surface. More specifically, an important feature of this nail-holding hammer head is that it will retain different lengths of finishing nails, i.e., the ones having small heads.

Hammer heads of this general construction and purpose are known in the art; a representative patent which is nearly a hundred years old was issued to F. G. Stark as U.S. Pat. No. 418,539 on Dec. 31, 1889. It shows a magnetized hammer head to hold a nail in a longitudinal groove on the underside of the head. There are transverse grooves to form shoulders for the nail heads to bear against so the nail can be driven into the intended object.

The Stark patent explains the use of such a nail-holding hammer head in pointing out that the nail which is so held may be driven into places where it otherwise would be impossible or extremely inconvenient to start the nail. Such a place could be one beyond the reach of a person or an awkward place where the person would be likely to hit fingers which are holding the nail. One disadvantage of the Stark hammer is that the nail is held on the underside of the head and this would prevent starting the nail close to a corner.

Another patent which is nearly as old is U.S Pat. No. 509,399 which issued on Nov. 28, 1893 to J. C. Richardson. It describes a wedge-shaped groove on the side of a hammer head to temporarily hold a nail which is to be driven beyond a person's reach. These and other patents which have issued showing nail-holding hammer heads have all suffered the common drawback of not being adapted to the small headed finishing nail. They have been useful for the so called "common" nail which have large heads but the small heads of the finishing nails have tended to slip out of place during the striking blow.

A foremost feature of the present invention is that finishing nails of different lengths will be handled equally as well as the common nails will be handled. In this respect the present hammer head provides shoulders along its length which present striking surfaces for the particular length nail to bear against. These shoulders provide a more than adequate surface area to sustain the nail inserting blow when it is driven into an object.

A preferred embodiment of the invention is illustrated in the accompanying drawing in which:

FIG. 1 is a side elevational view of the upper part of the hammer with a common nail in place, FIG. 2 is a plan view of FIG. 1 with the nail removed, FIG. 3 is a vertical sectional view on the line 3—3 of FIG. 2 on an enlarged scale and with a finishing nail in place, FIG. 4 is similar to FIG. 3 but showing a longer finishing nail in another place, FIG. 5 is a partial section on the line 5—5 of FIG. 4 and FIG. 6 is a partial sectional view on the line 6—6 of FIG. 4.

A feature of the invention is that its construction may be applied to the head of a conventional hammer 10 in which the head is integral with handle. This is because the top surface of the hammer head is solid and the grooves which are essential to the construction can be cut or formed in the top surface of the hammer. However, the invention may be applied to the conventional hammer head which has a hole through it to receive the upper end of a wooden handle but this introduces some limitations in the lengths of nails which can be accommodated.

The hammer head usually has the enlarged forward portion 11 which provides the striking face 12 and it has the necked-in portion 13, between the handle and the enlarged part 11. The other, rearward end of the head generally has the claw shape 14 for the removal of nails but sometimes it has a peen or rounded surface, suitable for metal working.

Vertically through the necked part 13 of head, i.e., parallel to the general axis of the handle, is a hole in which is firmly held a magnet 15. This may be a driven fit which permits it to be forced out and be replaced with a new stronger magnet if this is desired. A conventional ceramic magnet is suitable. This magnet serves to temporarily hold a nail in place as will be explained.

The top surface of the magnet 15 preferably conforms to the surrounding surface of the necked portion 13 but it can project slightly upwardly if it has a groove along it which conforms to the top lengthwise groove of the invention to be explained. It is advisable to conform the bottom surface of the magnet 15 to the surrounding surface to present a better appearance and increase the marketability of the hammer.

Lengthwise or longitudinally along the top surface of the hammer head is formed the groove 17 and it should be deeper than it is wide. Its side walls should diverge from each other in an outward direction as is shown in FIGS. 5 and 6, or in other words, the side walls of the longitudinal groove taper downwardly and inwardly toward each other. This lengthwise groove 17 should more or less be in the center of the width of the hammer head and it should extend from the front striking face 12 to at least the axis of the handle.

The length of the longitudinal groove 17 determines to some extent the maximum length of the nail which can be accommodated as will appear. An important feature of the invention is that the bottom of this lengthwise groove is not a straight line as might be supposed but is stepped as is evident from FIGS. 3 and 4. The purpose of this will also be hereinafter explained.

The portion of the groove 17 between the magnet 15 and its furthermost rearward end is interrupted by several transverse or cross grooves 18, 20, 22 and 24. There are four of these cross grooves in the illustrated embodiment of the invention but there can be fewer or more and they do not necessarily have to be equally distant apart.

These transverse grooves are deeper than the lengthwise groove 17 and are provided to receive the heads of the nails; they must be deep enough to fully receive the heads of common nails. In like manner they must be wide enough across the hammer head to not bind the nail heads and in fact these transverse grooves may extend across the full width of the hammer.

The rearward walls of the cross grooves provide the striking surfaces or abutment areas for the nail heads to bear against. Thus, the groove 18 has the rear striking wall 19, the groove 20 has the rear striking wall 21, the groove 22 has the rear striking wall 23 and the cross groove 24 has the rear striking wall 25.

In FIG. 3 the relatively short finishing nail 27 is located with its head in the groove 18 and it bears against the striking surface 19. In FIG. 4 the relatively long finishing nail 28 has its head located in the groove 22 and it bears against the rear striking wall 23. Obviously, the heads of other length nails would more suitably be located in the transverse grooves 20 and 24.

It has been mentioned that the bottom of the lengthwise groove 17 is not a straight line but instead is stepped between the cross notches. If the bottom of groove 17 were a straight line the relatively small heads of finishing nails would not have sufficient bearing contact against the rear walls 19, 21, 23 and 25. This is remedied by the present invention because of the stepped arrangement of the bottom between the transverse grooves.

In this respect it will be noted that the bottom of the portion 30 of the lengthwise groove between the front end 12 and the transverse groove 18 slopes downwardly and rearwardly fairly steeply. The portion 31 between cross grooves 18 and 20 slopes less steeply and is higher than the front portion 30. The portion at 32 between cross grooves 20 and 22 slopes even less steeply with the result that it is higher than the portion 31. In like manner the end portion 33 is disposed even higher.

The bottom of the longitudinal groove 17, therefore, is progressively stepped upward between the transverse grooves, from the front end to the rear end of this groove 17. This permits a maximum amount of the heads of the finishing nails to abut against the rear wall of the selected cross groove in which the nail head lies. Irrespective of such a location of the nail head the body of the nail lies against or close to the magnet 15 so that the nail is held in place on the hammer head.

The hammer is used in the same way and for the same purpose which is described in the above mentioned prior patents and it overcomes the likelihood that the nail will pass beyond its striking or bearing surface when the nail is to be started.

I claim:

1. A hammer head having a longitudinal groove leading away from the striking face to temporarily receive the shank of a nail to be struck into a receiving surface, and having a plurality of transverse grooves crossing the longitudinal groove along its length at spaced intervals to receive the nail heads and provide nail head abutment surfaces, the bottom of the longitudinal groove being stepped upwardly between said transverse grooves away from the striking surface so that the heads of finishing nails will bear against said abutment surfaces.

2. A hammer head according to claim 1 in which the stepped surfaces slope generally toward the point where the longitudinal groove meets the striking surface.

3. A hammer head according to claim 1 in which a magnet embedded in the head restrains a nail in the longitudinal groove.

4. A hammer head according to claim 3 in which the axis of the magnet is generally perpendicular to the length of the hammer head.

* * * * *